US010647144B2

(12) United States Patent
Koitabashi et al.

(10) Patent No.: US 10,647,144 B2
(45) Date of Patent: May 12, 2020

(54) INK JET RECORDING METHOD

(71) Applicant: CANON KABUSHIKI KAISHA, Tokyo (JP)

(72) Inventors: Noribumi Koitabashi, Yokohama (JP); Takao Ogata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/275,587

(22) Filed: Feb. 14, 2019

(65) Prior Publication Data

US 2019/0263167 A1 Aug. 29, 2019

(30) Foreign Application Priority Data

Feb. 23, 2018 (JP) ..... 2018-030887

(51) Int. Cl.
*B41J 11/00* (2006.01)
*B41M 7/00* (2006.01)
*B41J 2/015* (2006.01)

(52) U.S. Cl.
CPC ..... *B41M 7/009* (2013.01); *B41J 2/015* (2013.01); *B41J 11/002* (2013.01); *B41M 7/0054* (2013.01)

(58) Field of Classification Search
CPC ..... B41J 11/002; B41J 11/0015; B41J 2/015; B41M 7/0018; B41M 7/00; B41M 7/0036; B41M 7/0027; B41M 7/0054; B41M 7/009
See application file for complete search history.

(56) References Cited

U.S. PATENT DOCUMENTS

| | | | | |
|---|---|---|---|---|
| 6,379,000 | B1 | 4/2002 | Koitabashi | |
| 6,533,409 | B2 | 3/2003 | Koitabashi | |
| 6,786,587 | B2 | 9/2004 | Koitabashi | |
| 6,916,092 | B2 | 7/2005 | Koitabashi et al. | |
| 8,052,271 | B2 | 11/2011 | Kunimine et al. | |
| 9,566,781 | B2 | 2/2017 | Takeuchi et al. | |
| 2005/0212882 | A1 | 9/2005 | Naniwa | |
| 2005/0233119 | A1* | 10/2005 | Mizutani | B32B 27/06 428/195.1 |
| 2011/0045395 | A1* | 2/2011 | Fujiwara | G03G 9/0804 430/108.1 |

FOREIGN PATENT DOCUMENTS

JP 2005-271290 A 10/2005

* cited by examiner

*Primary Examiner* — Scott A Richmond
(74) *Attorney, Agent, or Firm* — Venable LLP

(57) ABSTRACT

The ink jet recording method according to the invention is characterized by that at least one of an ink and a surface treatment agent contains a resin that melts or softens at a fixing temperature by heat treatment; the surface treatment agent contains at least two kinds of particles different in particle size that do not melt at the fixing temperature; the particles contain first particles and second particles having a particle size larger than that of the first particles; and the second particles have a particle size falling within a range of more than 50 nm to less than 110 nm.

10 Claims, 6 Drawing Sheets

INK JET RECORDING METHOD

BACKGROUND OF THE INVENTION

Field of the Invention

The present invention relates to an ink jet recording method.

Description of the Related Art

Ink jet recording apparatuses have been used widely as a computer-related output machine or the like from the standpoint of a low running cost, possibility of reducing their size, and easy adaptation to color image recording with inks of a plurality of colors.

Pigment inks using a pigment as a coloring material have recently been the mainstream of an ink for forming images by ink jet recording apparatuses. Also from the standpoint of outputting images with photographic quality, there is a demand for the output of high-gloss images by using ink jet recording apparatuses using a pigment ink.

Japanese Patent Application Laid-Open No. 2005-271290 proposes a method of forming an image while controlling the gloss of the image by adjusting the amount of a solvent contained in an image-forming ink on a recording medium by removing the solvent or adding a fixing auxiliary liquid and then fixing the image to the recording medium by a heat fixing unit. The fixing auxiliary liquid described in Japanese Patent Application Laid-Open No. 2005-271290 is a liquid permitting easy melting or softening of coloring material particles in the image-forming ink, improving the meltability at the time of heat fixing and thereby accelerating heat fixing of the image. Examples of a component of the fixing auxiliary liquid include various liquids such as organic solvents and silicone oils.

SUMMARY OF THE INVENTION

An object of the invention is to provide an ink jet recording method capable of stably releasing a fixing member from an image in a fixing step which imparts gloss to the image.

According to one aspect of the invention, there is provided an ink jet recording method including an image forming step for adding an ink containing a pigment as a coloring material to a recording medium to form an image; a surface treatment agent adding step for adding a surface treatment agent for modifying the surface of the image to the image formed on the recording medium; and a fixing step for heating the surface treatment agent-added image to a fixing temperature, bringing a fixing member into contact with the image and applying a pressure thereto, and then releasing the fixing member from the image to fix the image to the recording medium. In this method, at least one of the ink and the surface treatment agent contains a resin that melts or softens at the fixing temperature; the surface treatment agent contains at least two kinds of particles different in particle size that do not melt at the fixing temperature; the particles contain first particles and second particles having a particle size larger than that of the first particles; and the second particles have a particle size within a range of from more than 50 nm to less than 110 nm.

Further features of the present invention will become apparent from the following description of exemplary embodiments with reference to the attached drawings.

DESCRIPTION OF THE EMBODIMENTS

Figure 1:
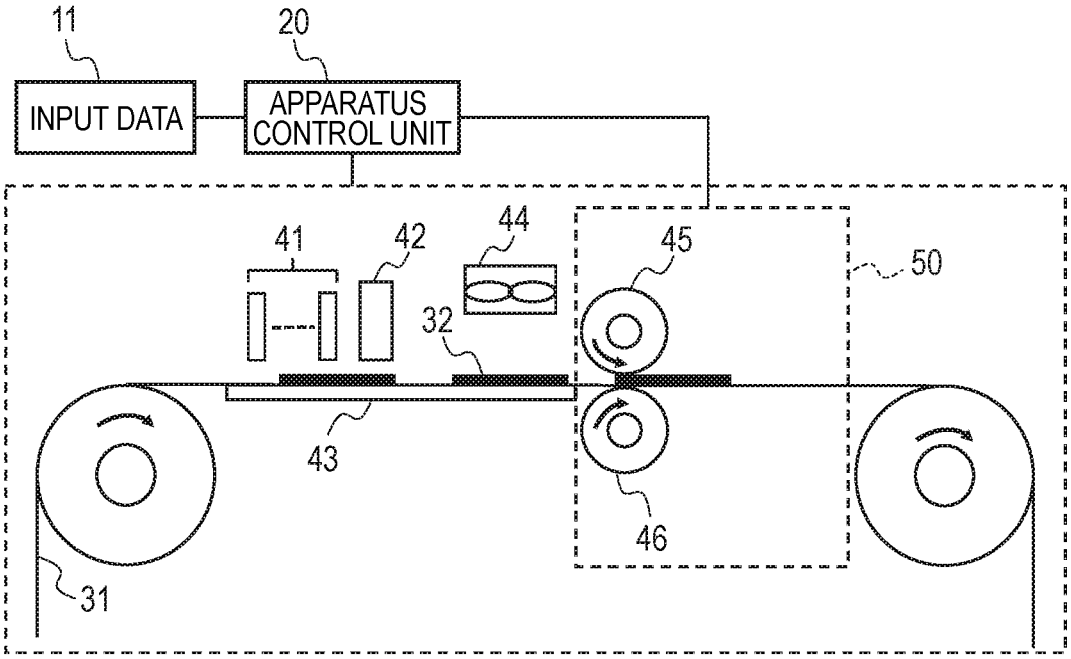
FIG. 1 is a schematic view showing the constitution of an ink jet recording apparatus usable in an ink jet recording method according to one embodiment of the invention.

Addition of a solvent such as a fixing auxiliary liquid to an image portion for imparting high gloss thereto as described in Japanese Patent Application Laid-Open No. 2005-271290 may increase the adhesive force between a fixing member and the surface of an image and make it difficult to release the fixing member from the image. In such a case, there may occur inconvenience such as release failure of a recording medium from the fixing member or exfoliation of the image from the recording medium.

With a view to achieving stable release of the fixing member from the image, the present inventors have carried out an extensive investigation and made the invention.

The present inventors have considered the above-described related art deeply and carried out an extensive investigation. As a result, it has been found that an ink jet recording method having the following steps is effective for achieving the above-described object, leading to completion of the invention.

The ink jet recording method of the invention has the following steps.

(1) An image forming step for adding an ink containing a pigment as a coloring material to a recording medium to form an image.

(2) A surface treatment agent adding step for adding a surface treatment agent for modifying the surface of the image to the image formed on the recording medium.

(3) A fixing step for heating the surface treatment agent-added image to a fixing temperature, bringing a fixing member into contact with the image to apply a pressure thereto and then, releasing the fixing member from the image to fix the image to the recording medium.

At least one of the ink and the surface treatment agent used in the above steps contains a film forming resin that melts or softens at the fixing temperature.

The surface treatment agent contains surface treatment particles for modifying the surface of the image. The surface treatment particles keep a solid state without melting by heating to the fixing temperature, change neither their shape nor size, and adhere to at least the surface of the image and modify the surface of the image. These surface treatment particles are composed of particles different in particle size and contain at least one combination of first particles and second particles having a particle size larger than that of the first particles. The second particles have a particle size falling within a range of more than 50 nm to less than 110 nm. Using the surface treatment particles and the film forming resin in combination makes it possible to provide an image having an improved surface state and achieve smooth release of the fixing member from the image while imparting gloss to the image.

The image forming step may include, in addition to an ink adding step for adding an ink to a recording medium, a reaction liquid adding step for adding a reaction liquid containing an ink viscosity increasing component. The image forming step may be either a step of directly adding an ink to a recording medium to form an image on the recording medium or a step of adding an ink or a reaction liquid and an ink to a transfer body to form an image on the transfer body and transferring the image from the transfer body to the recording medium to form the image on the recording medium. A step of transferring the image formed on the transfer body to the recording medium may also be called "transfer step". This means that the image forming step may include the transfer step.

As described above, the ink jet recording method of the invention includes a surface treatment agent adding step for modifying the surface state of the image before the fixing step in order to overcome the above-described problem and obtain a recording medium with a glossy image.

In the surface treatment agent adding step, after addition of an ink to a recording medium, a surface treatment agent is added onto an image having an ink layer formed by the ink. It is necessary to form an ink layer having, after the fixing step, high smoothness and at the same time, to release the ink layer completely from a fixing member in the fixing step. In order to satisfy these necessities, a film forming resin is added to at least one of the ink and the surface treatment agent and surface treatment particles for forming, on the surface of the ink layer after fixing, minute unevenness serving as a trigger of the release are added to the surface treatment agent.

In addition, the surface treatment agent preferably is colorless or has a color not affecting the image formed on the recording medium and at the same time, is transparent.

The surface treatment particles contain at least two kinds of particles different in particle size and at the same time, contain one or more combinations of larger particle size particles and smaller particle size particles. For example, the surface treatment particles may contain a combination of larger particle size particles and smaller particle size particles or may contain particles having three respectively different particle sizes, that is, larger, medium and smaller particle size particles, meaning that they contain two combinations of larger particle size particles and smaller particle size particles.

The surface treatment particles and the film forming resin are added to the recording medium in the following modes:

(A) a method of incorporating the film forming resin in an ink and the surface treatment particles in the surface treatment agent, respectively, and adding them to the recording medium;

(B) a method of incorporating both the film forming resin and the surface treatment particles in the surface treatment agent and adding the resulting surface treatment agent to the recording medium;

(C) a method of incorporating the film forming resin in an ink and incorporating both the film forming resin and the surface treatment particles in the surface treatment agent and adding them to the recording medium; and (D) a method of preparing a two-component type surface treatment agent composed of a surface treatment agent containing the film forming resin and another surface treatment agent containing the surface treatment particles and adding these components to the recording medium in order of mention. It is however preferred to incorporate the film forming resin in the surface treatment agent to obtain a desirable mixture of the surface treatment particles and the film forming resin.

In the image forming step, an image is formed on a recording medium by an ink jet method using an ink having a coloring material. Then, the surface treatment agent is added onto at least the ink layer on the recording medium to form an image having a liquid or gel ink layer.

Here, surface treatment of the ink layer in the case where emulsion resin particles are used as the film forming resin of the surface treatment agent as exemplified above as the mode (B) will be described. The surface treatment agent is added to the image on the recording medium, followed by heating to a temperature higher than the minimum film forming temperature (MFT) of the emulsion resin particles. Then, in the surface treatment agent layer added to the image, the emulsion resin becomes a fluid and enters a space between the surface treatment particles. As a result, the surface treatment agent layer is formed into a film with the particles being bonded to each other with the emulsion resin and by a pressure applied by means of a fixing member and cooling after release of the fixing member, the image can be fixed firmly to the recording medium.

A mechanism capable of producing such an advantage of the invention will hereinafter be described using a simple aspect using, as the surface treatment particles, two kinds of particles, that is, particles with a larger particle size (large particle size particles) and particles with a smaller particle size (small particle size particles).

Figure 2A:
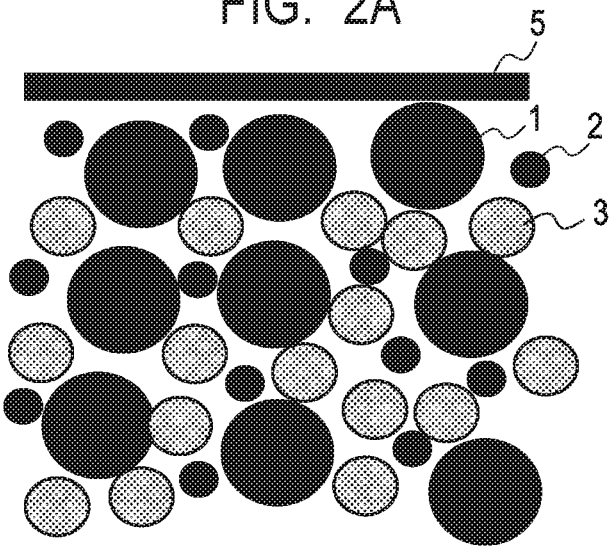
FIGS. 2A, 2B and 2C are each a schematic view, before and after application of heat and pressure, showing the cross-section of a surface treatment agent layer formed on a recording medium in the one embodiment of the invention.
Figure 2B:
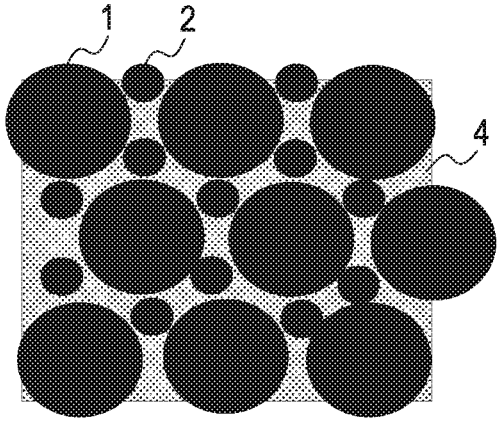
Figure 2C:
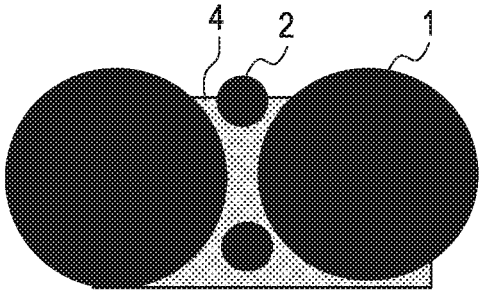

FIGS. 2A, 2B, and 2C are schematic cross-sectional views in the thickness direction of a recording medium showing a change, between before and after a fixing step, of the state of the surface treatment agent layer formed on the image. FIG. 2A shows the cross-section of the surface treatment agent layer before fixing and FIG. 2B shows the cross-section of the surface treatment agent layer after fixing. FIG. 2C is an enlarged view of the cross-section shown in FIG. 2B. The fixing step in FIGS. 2A, 2B and 2C is a heat and pressure fixing step for heating the image while bringing a fixing member into contact with the image and applying a pressure thereto.

In the surface treatment agent layer before application of heat and pressure by a fixing member 5, particles with a larger particle size (large particle size particles) 1, particles with a smaller particle size (small particle size particles) 2 and emulsion resin particles 3 are present as a mixture (refer to FIG. 2A). When the emulsion resin particles 3 are heated to a fixing temperature higher than the MFT thereof and a pressure is applied thereto by the fixing member 5, the emulsion resin particles 3 form a film 4 among the particles and these particles are fixed. With the formation of the resulting film, a flat surface corresponding to a pressure-applying surface of the fixing member 5 is formed on the surface of the surface treatment agent layer (refer to FIGS. 2B and 2C). Arrangement of the small particle size particles 2 between the large particle size particles 1 makes it possible to achieve good release of the fixing member 5 from the surface treatment agent layer on the image and to provide, with smoothness for attaining intended gloss, the surface of the surface treatment agent layer on the image released from the fixing member 5.

On the other hand, the two-component type surface treatment agent described above in the aspect (D) is preferred because the surface treatment agent layer can be divided into a thin particle layer containing a less amount of particles to be added onto the image and a resin layer which is on the back side of the thin particle layer and bonds particles each other to form a film.

Figure 3A:
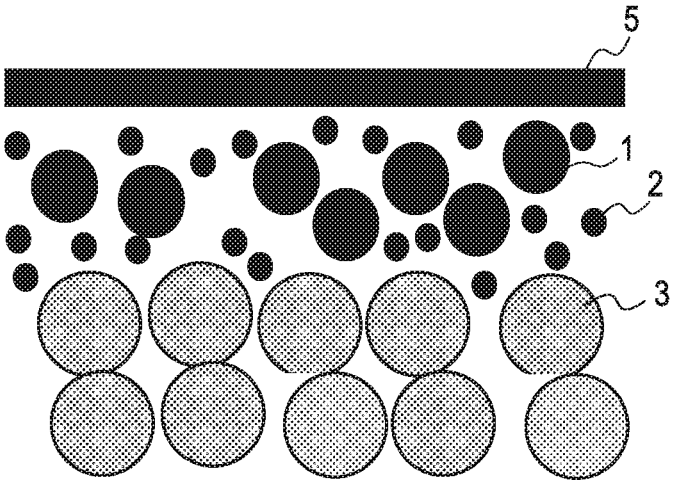
FIGS. 3A, 3B and 3C are each a schematic view, before and after application of heat and pressure, showing the cross-section and surface of the surface treatment liquid layer formed on the recording medium in the one embodiment of the invention.
Figure 3B:
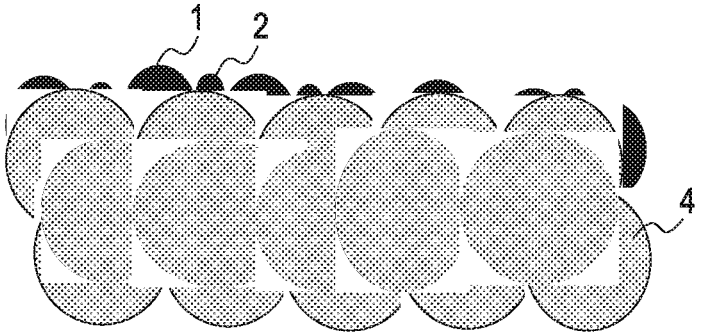
Figure 3C:
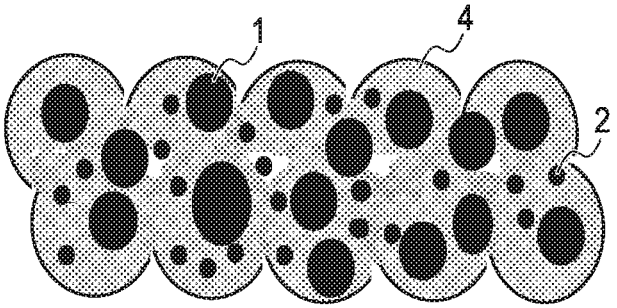

FIGS. 3A, 3B and 3C are schematic cross-sectional views in the thickness direction of a recording medium showing a change in the state of the surface treatment agent layer formed on the image in such fixing step. FIG. 3A shows the cross-section of the surface treatment agent layer before application of a pressure in the fixing step, FIG. 3B shows the cross-section of the surface treatment agent layer after application of a pressure in the fixing step and FIG. 3C shows the surface of the surface treatment agent layer after application of a pressure in the fixing step. The fixing step in FIGS. 3A to 3C is, similar to that in FIGS. 2A to 2C, a heat and pressure fixing step for heating the image while bringing a fixing member into contact with the image and applying a pressure thereto.

The surface treatment agent layer before application of a pressure by the fixing member 5 is comprised of a surface layer having a mixture of the large particle size particles 1 and the small particle size particles 2 and a lower layer including the emulsion resin particles 3 (refer to FIG. 3A). When the emulsion resin particles 3 are heated to a fixing temperature higher than the MFT thereof and at the same time, a pressure is applied thereto by the fixing member 5, the lower layer is formed into a film 4 by the emulsion resin particles 3. With the formation of this film, the thin particle layer including the large particle size particles 1 and the small particle size particles 2 is fixed to the surface of the film of the lower layer (refer to FIGS. 3B and 3C). Arrangement of the small particle size particles 2 between the large particle size particles 1 in the thin particle layer formed on the surface makes it possible to achieve good release of the fixing member 5 from the surface treatment agent layer on the image and to provide, with smoothness for attaining intended gloss, the surface of the surface treatment agent layer on the image released from the fixing member 5.

In the aspect shown in FIGS. 2A to 2C and FIGS. 3A to 3C, the surface treatment particles are comprised of particles having two respectively different particle sizes and the small particle size particles 2 and the resin 3 are caused to enter the space between the large particle size particles 1 serving as a basic skeleton so that they can be arranged with a smaller porosity. This makes it possible to form a denser film and compared with use of only the large particle size particles 1, the surface of the image has better smoothness and the image thus obtained has improved glossiness.

The invention will hereinafter be described more specifically based on embodiments relating to the composition and adding method of a reaction liquid, a surface treatment agent, an ink and the like and each process for image formation.

<Reaction Liquid>

In order to increase the viscosity of an ink to be added onto a recording medium and achieve improvement in stability of an image, a reaction liquid containing a viscosity increasing component of an ink can be used for the image formation on the recording medium before fixing. The reaction liquid can be added to the recording medium before or after addition of an ink. Preferably, the reaction liquid is added to the surface of the recording medium before addition of an ink. Addition of the reaction liquid before addition of an ink can prevent bleeding caused by mixing of adjacent inks added at the time of image recording by an ink jet system or beading caused by attraction of an ink which has already impacted to an ink which has just impacted.

When an ink is brought into contact with the reaction liquid on the recording medium to form an ink layer which will be an image, layer separation between the ink layer and a surface treatment agent layer to be formed thereon is likely to occur, which is preferred because an interface of the image with the fixing member in the fixing step becomes a surface having no coloring material of the ink or a surface poor in the coloring material but rich in a component supplied from the surface treatment agent.

By drying treatment of the image formed using the ink and the reaction liquid, at least a portion of a liquid component is removed from the image in liquid or gel form and an ink aggregation layer is formed.

The reaction liquid contains an ink viscosity increasing component. The term "ink viscosity increasing" means not only the case where a viscosity increase of the whole ink resulting from chemical reaction or physical adsorption caused by the contact between the coloring material, resin or the like in the ink and an ink viscosity increasing component is recognized but also the case where a local viscosity increase due to aggregation of some of the components such as coloring material is recognized. As the ink viscosity increasing component, those capable of producing a desired aggregation effect by increasing the viscosity of the ink such as polyvalent metal ions, organic acids, cationic polymers and porous fine particles can be selected for use. Of them, polyvalent metal ions and organic acids are particularly preferred. It is also preferred to incorporate several ink viscosity increasing components in the reaction liquid.

The content of the ink viscosity increasing component in the reaction liquid is preferably 5 mass % or more based on the total mass of the reaction liquid.

Examples of the metal ion usable as the ink viscosity increasing component include divalent metal ions such as $Ca^{2+}$, $Cu^{2+}$, $Ni^{2+}$, $Mg^{2+}$, $Sr^{2+}$, $Ba^{2+}$ and $Zn^{2+}$ and trivalent metal ions such as $Fe^{3+}$, $Cr^{3+}$, $Y^{3+}$ and $Al^{3+}$. Examples of the organic acid usable as the ink viscosity increasing component include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumaric acid, thiophenecarboxylic acid, nicotinic acid, oxysuccinic acid, and dioxysuccinic acid.

The reaction liquid may contain an adequate amount of water or an organic solvent. Water used for it is preferably water deionized by ion exchange or the like. The organic solvent usable for the reaction liquid is not particularly limited and any known organic solvents can be used.

The reaction liquid can be used after adjustment of its surface tension or viscosity as needed by the addition of a surfactant or viscosity regulator. Any surfactant or viscosity regulator may be used insofar as it can coexist with the ink viscosity increasing component and can adjust the surface tension or viscosity into an intended one. Examples of the surfactant include Acetylenol E100 (trade name; product of Kawaken Fine Chemicals).

<Addition of Reaction Liquid>

The reaction liquid can be added to the surface of the recording medium by various known method as needed. Examples include die coating, blade coating, a method using a gravure roller, a method using an offset roller and spray coating. Addition by an ink jet method with a liquid ejection head such as an ink jet recording head is also preferred. Further, a plurality of methods may be used in combination.

<Image Formation>

The image forming step according to the present embodiment has a reaction liquid adding step and an ink adding step.

In the ink adding step, an ink is added to a recording medium by means of an ink jet recording head and an ink layer which will be an image is formed.

Examples of an ink ejection system using the ink jet recording head include the following systems:

- A system of ejecting an ink by causing film boiling of an ink and forming air bubbles by means of an electro-thermal converter.
- A system of ejecting an ink by means of an electro-mechanical converter.
- A system of ejecting an ink by making use of static electricity.

The constitution of an ink jet recording head to be used for the formation of an image is not particularly limited insofar as it can be used for the formation of an image with an ink. From the standpoint of forming a high-density image at a high speed, an ink jet recording head using an ink ejection system making use of an electro-thermal converter is particularly preferred.

An operation mode of the ink jet recording head is also not particularly limited. A so-called shuttle type ink jet recording head which forms an image while scanning with the head in a direction orthogonal to the running direction of the recording medium can be used. A so-called line-head type ink jet recording head having ink ejection ports arranged in line in a direction substantially orthogonal to the running direction of the recording medium (in other words, in a direction substantially parallel to the axis direction of a drum shape) can also be used.

Further, a recording system is not particularly limited and for example, either of the following recording systems can be used when the shuttle type ink jet recording head is used.

- A multi-path recording system, by which recording is performed by a plurality of times of scanning for the same recording position.
- A one-path recording system, by which recording is performed by single scanning for one recording position.

Further, a method of recording after dividing an image into a plurality of mask patterns can also be used.

<Ink>

Components for preparing an ink will hereinafter be described, respectively.

[Coloring Material]

An ink can be prepared using at least a coloring material and a liquid medium.

As the coloring material, at least one of dyes usable as a coloring material of an ink and pigments such as carbon black, inorganic pigments and organic pigments can be used. The coloring material can be incorporated in the ink while being dissolved and/or dispersed in the liquid medium. Of these, various pigments are characterized by durability and quality of printed matters so that use of at least a pigment as the coloring material is preferred.

[Pigment]

The pigment as the coloring material is not particularly limited and known inorganic pigments, organic pigments and the like can be used. More specifically, pigments indicated by C. I. (Color Index) Number can be used. As a black pigment, also carbon black is preferably used. Examples of the pigment include self dispersing pigments and dispersant-dispersing pigments which are pigments dispersed by a dispersant. These pigments may be used either singly or in combination.

The content of the coloring material in the ink is preferably 0.5 mass % or more to 15.0 mass % or less, more preferably 1.0 mass % or more to 10.0 mass % or less, each based on the total mass of the ink.

[Pigment Dispersant]

As the dispersant for dispersing the dispersant-dispersing pigment, any dispersant having a function of dispersing a pigment in an ink jet ink can be used. When the ink is a water-based one, any pigment used for dispersing a pigment or the like for the water-based ink may be used. For example, pigment-dispersing dispersants used in a known ink jet water-based ink can be used either singly or in combination.

As the dispersant for water-based ink, a water-soluble dispersant having, in a molecular structure thereof, both a hydrophilic moiety and a hydrophobic moiety is preferred. In particular, a pigment dispersant composed of a resin obtained by copolymerizing at least a hydrophilic monomer and a hydrophobic monomer is preferably used. The monomers usable here are not particularly limited insofar as an intended dispersant can be obtained using them and, for example, known monomers can be selected for use. Specific examples of the hydrophobic monomer include styrene, styrene derivatives, alkyl (meth)acrylates and benzyl (meth) acrylate. Examples of the hydrophilic monomer include acrylic acids, methacrylic acids and maleic acid.

The dispersant has preferably an acid value of 50 mgKOH/g or more to 550 mgKOH/g or less. The dispersant preferably has a weight-average molecular weight of 1000 or more to 50000 or less.

A pigment:dispersant ratio (in terms of mass) preferably falls within a range of from 1:0.1 to 1:3.

Examples of the self-dispersing pigment include pigments having a surface modified to make them dispersible in a water-based liquid medium of an ink.

[Resin Component]

The ink may contain a film forming resin as a component of a surface treatment agent which will be described later. When the ink contains this resin, an ink aggregation layer can be formed into a film by heating.

The content of the film forming resin in the ink is preferably 1 mass % or more to 50 mass % or less, more preferably 2 mass % or more to 40 mass % or less, each based on the total mass of the ink.

When film-forming resin particles are used upon preparation of an ink, a resin particle dispersion having resin particles dispersed in a liquid is preferably used. A dispersing method is not particularly limited, but a so-called self-dispersing resin fine-particle dispersion obtained by dispersing particles composed of a resin obtained by homopolymerization of a dissociating group-containing monomer or copolymerization of a plurality of dissociating group-containing monomers is preferred. Examples of the dissociating group include carboxyl group, sulfonic acid group and phosphoric acid group and examples of the dissociating group-containing monomer include acrylic acid and methacrylic acid. A so-called emulsification dispersion type resin-particle dispersion obtained by dispersing resin fine particles by the aid of an emulsifier can also be used preferably. As the emulsifier, any emulsifier irrespective of whether it has a low molecular weight or a high molecular weight can be used insofar as it can produce an intended dispersing effect. For example, known surfactants can be used preferably. A nonionic surfactant or a surfactant having a charge same as that of the resin fine particles is preferred.

As the resin particles, fine particles having a dispersed particle size of 10 nm or more to 1000 nm or less are preferred, with those having a dispersed particle size of 100 nm or more to 500 nm or less being more preferred.

Upon preparation of the resin particle dispersion, various additives are preferably added for stabilization. Examples of the additives include n-hexadecane, dodecyl methacrylate, stearyl methacrylate, chlorobenzene, dodecylmercaptane, olive oil, blue dyes (bluing agent: Blue 70) and poly(methyl methacrylate). These additives may be used either singly or in combination.

When the film forming resin particles are added to an ink as a component to be aggregated by a reaction with the ink viscosity increasing component of the reaction liquid, resin particles that react with the ink viscosity increasing component of the reaction liquid to cause aggregation are preferably used. For example, when the ink viscosity increasing component of the reaction liquid is cationic, anionic resin particles are preferably used.

The minimum film forming temperature of the resin particles is preferably 180° C. or less in consideration of a thermal energy efficiency at the time of forming the ink aggregation layer into a film by heating.

[Surfactant]

The ink may contain a surfactant. Specific examples of the surfactant include Acetylenol EH (trade name; product of Kawaken Fine Chemicals). The content of the surfactant in the ink is preferably 0.01 mass % or more to 5.0 mass % or less based on the total mass of the ink.

[Water and Water-Soluble Organic Solvent]

The ink contains a liquid medium. As the liquid medium, water or a water-based liquid medium such as a mixed medium between water and a water-soluble organic solvent can be used. Water is preferably deionized water obtained by ion exchange or the like. The content of water in the ink is preferably 30 mass % or more to 97 mass % or less based on the total mass of the ink.

The kind of the water-soluble organic solvent is not particularly limited and any known organic solvents used in an ink jet water-based ink can be used. Specific examples include glycerin, diethylene glycol, polyethylene glycol and 2-pyrrolidone. The content of the water-soluble organic solvent in the ink is preferably 3 mass % or more to 70 mass % or less based on the total mass of the ink.

[Other Additives]

The ink may contain, in addition to the above-described components, various additives such as pH regulator, rust inhibitive, antiseptic, mildew proofing agent, antioxidant, reduction preventive, water soluble resin and neutralizing agent thereof and viscosity regulator. These additives may be used either singly or in combination.

<Surface Treatment Agent>

Components for preparing a surface treatment agent will hereinafter be described.

The followings are modes of the surface treatment agent.

(a) A surface treatment agent having, as a surface treatment component thereof, only surface treatment particles and used in combination with the film forming resin incorporated in the ink.

(b) A surface treatment agent having, as a surface treatment component thereof, both surface treatment particles and the film forming resin.

(c) A two-component type surface treatment agent consisting of a first surface treatment agent having, as a surface treatment component thereof, only surface treatment particles and a second surface treatment agent having, as a surface treatment component thereof, only the film forming resin. The surface treatment agent of the above-described mode (b) may be used in combination with an ink containing the film forming resin.

[Film Forming Resin]

Addition of a combination of the film forming resin and the surface treatment particles to an image makes it possible to provide the resulting image with gloss by the fixing step and to release a fixing member smoothly from the image in the fixing step. In addition, addition of the film forming resin to an image enables the image on the recording medium to have enhanced mechanical strength. The image having the resin added thereto is expected to have improved water resistance, though depending on the kind of the resin. The film forming resin to be added to the image via the surface treatment agent is not limited insofar as it has the above-described intended function. The film forming resin to be incorporated, together with the surface treatment particles, in the surface treatment agent is not limited insofar as it can coexist with the surface treatment particles and has the above-described intended function.

The film forming resin to be used for such a purpose can be incorporated, in a solution form, an emulsion form or suspension form, in the surface treatment agent.

As described above, the film forming resin may be incorporated in an ink as a film forming resin of an ink aggregation layer.

The film forming resin is not involved in color development of an image-forming ink layer but is necessary as a component that softens or melts into a film by the heat treatment up to the fixing temperature. As the film forming resin, a nonionic resin or a resin having polarity or charge can be used.

The film forming particles can also be used as a component that aggregates by the reaction with the ink viscosity increasing component of the reaction liquid contained in the image-forming ink layer. In this case, a film forming resin having polarity different from that of the ink viscosity increasing component of the reaction liquid is preferably used. For example, using an anionic film forming resin is preferred when the ink viscosity increasing component of the reaction liquid is cationic.

In order to achieve better film formation, the film forming resin to be used in combination with the surface treatment particles is preferably used in the form of resin particles for the preparation of the surface treatment agent.

The material of the resin particles is not particularly limited and known resins can be used as needed. Specific examples include homopolymerization products such as polyolefin, polystyrene, polyurethane, polyester, polyether, polyuria, polyamide, polyvinyl alcohol, poly(meth)acrylic acid and salt thereof, alkyl poly(meth)acrylate and polydiene and copolymerization products obtained using a plurality of these monomers for the formation of the above-described polymerization products. The resin constituting the resin particles preferably has a weight average molecular weight falling within a range of 1,000 or more to 2,000,000 or less. The content of the resin particles in the surface treatment agent is preferably 1 mass % or more to 50 mass % or less, more preferably 2 mass % or more to 40 mass % or less, each based on the total mass of the surface treatment agent.

In preparing the surface treatment agent, the resin particles are used preferably as a resin fine-particle dispersion having resin fine particles dispersed in a liquid. No particular limitation is imposed on a dispersing method, but a so-called self-dispersing resin fine-particle dispersion obtained by dispersing particles composed of a resin obtained by homopolymerization of a dissociating group-containing monomer or copolymerization of a plurality of dissociating group-containing monomers is preferred. Examples of the dissociating group include carboxyl group, sulfonic acid group and phosphoric acid group and examples of the dissociating group-containing monomer include acrylic acid and methacrylic acid. A so-called emulsification dispersion type resin fine-particle dispersion obtained by dispersing resin fine particles by the aid of an emulsifier can also be used preferably. As the emulsifier, any emulsifier irrespective of whether it has a low molecular weight or a high molecular weight can be used insofar as it can produce an intended dispersing effect. For example, known surfactants can be used preferably. A nonionic surfactant or a surfactant having a charge same as that of the resin fine particles is preferred.

Upon preparation of the resin fine-particle dispersion, various additives are preferably added for stabilization. Examples of the additives include n-hexadecane, dodecyl methacrylate, stearyl methacrylate, chlorobenzene, dodecylmercaptane, olive oil, blue dyes (Blue 70) and poly(methyl methacrylate). These additives may be used either singly or in combination.

As the resin particles, fine particles having a dispersion particle size of 10 nm or more to 1000 nm or less are preferred, with those having a dispersion particle size of 50 nm or more to 300 nm or less being more preferred.

When the film forming resin particles are added to an ink as a component to be aggregated by a reaction with the ink viscosity increasing component of the reaction liquid, resin particles that react with the ink viscosity increasing component of the reaction liquid to cause aggregation are preferably used. For example, when the ink viscosity increasing component of the reaction liquid is cationic, anionic resin particles are preferably used.

The resin particles are more preferably used in the form of emulsion resin particles for the preparation of the surface treatment agent. When the emulsion resin particles are used, they are preferably those forming a film at the fixing temperature, more specifically, those having, as the minimum film forming temperature, the fixing temperature or less and capable of forming a solidified and stable film at the time of cooling to a working temperature of the image after the fixing step.

There is a relationship in the particle size among the emulsion resin particles, the surface treatment first particles and the surface treatment second particles having a particle size larger than that of the first particles.

It is preferred that the particle size of the second particles is larger than that of the emulsion resin particles or the particle size of the first particles is smaller than that of the emulsion resin particles.

Further, using the second particles having a particle size larger than that of the emulsion resin particles in combination with the first particles having a particle size smaller than that of the emulsion resin particles is preferred.

Using such a combination of the first particles and the second particles prevents exposure of the surface of the film after film formation because the first particles attach to the surface of the emulsion resin particles between the second particles. This is presumed to result in an effect of reducing the adhesive force of the surface treatment agent layer to the fixing member and facilitating release of the surface treatment agent layer from the fixing member. Though depending on fixing conditions, a surface treatment agent not containing the second particles but containing, for example, small-particle size silica having a particle size of 10 nm and emulsion resin particles having a particle size of 60 nm may hinder the surface of the surface treatment agent layer from being smooth due to lumps formed by fusion of a plurality of small particle size silica. Mixing of the first particles and the second particles, on the other hand, is presumed to be effective for suppressing formation of lumps and improving smoothness of the surface treatment agent layer and releasability from the fixing member.

The minimum film forming temperature of the emulsion resin particles is preferably 180° C. or less in consideration of thermal energy efficiency in film formation by heating.

[Surface Treatment Particles]

The surface treatment particles contained in the surface treatment agent contain two or more kinds of particles different in particle size, meaning that they contain at least one combination of first particles and second particles having a particle size larger than that of the first particles. For example, the surface treatment particles may contain a combination of first particles and second particles having a particle size larger than that of the first particles or may contain a combination of first particles and second particles having a particle size larger than that of the first particles and a combination of third particles and fourth particles having a particle size larger than that of the third particles.

The surface treatment particles heat-treated up to the fixing temperature do not melt, keep their solid state and cause no change in their shape or size. They adhere to at least the surface of an image to modify thereof. Since these particles do not melt, their adhesive force to the fixing member does not increase and a certain degree of curvature is maintained, making it possible to keep the easily releasable state of the fixing member. Surface treatment particles having a too large particle size may damage the smoothness of the surface of the image and roughen the surface of the image by these particles. Scattering of light on the rough surface of the image may deteriorate the gloss of the image. From the optical standpoint, the particles are preferably smaller than the wavelength of light. On the other hand, surface treatment particles having a too small particle size cannot easily be added to the surface of the image uniformly because of aggregation lumps formed easily as a result of enhanced aggregation force between the surface treatment particles. The image thus obtained inevitably has a surface with deteriorated smoothness. In addition, the surface treatment particles having a too small particle size are likely to be buried in the resin layer formed by the film forming resin even if the aggregation force between the surface treatment particles can be reduced. This facilitates generation of particles that fail to come into contact with the fixing member. In such a case, releasability of the fixing member from the image lowers in the fixing step. The particle size of the second particles is therefore selected from a range of more than 50 nm to less than 110 nm.

The particle size of the first particles is preferably 50 nm or less, more preferably less than 50 nm, further more preferably 10 nm or more to 50 nm or less in consideration that the first particles improve the smoothness of the surface of the image, entering spaces formed by a large number of the second particles.

The particle size of the first particles is more preferably about 0.4 time or less (2/5 or less) the particle size of the second particles. Particles having such a particle size can reduce a depth of the surface unevenness between a film formed by the film forming resin and a surface of a portion made of the second particles and at the same time reduce a porosity compared with that of the surface treatment particles having one particle size and as a result, the surface of the image thus obtained can have more improved smoothness.

The first particles and the second particles are added preferably at a ratio (mass ratio) of 1:9 or more to 5:5 or less, because the surface treatment particles containing the first particles at a ratio larger than the above-described range are likely to form lumps.

When the surface treatment agent has one combination of the first particles and the second particles, the particle size distribution of the surface treatment particles preferably has two peaks.

For example, usable is a combination of the first particles and the second particles capable of giving a particle size distribution having a first peak within a range of 10 nm or more to 50 nm or less and a second peak within a range more than 50 nm to less than 110 nm.

In selecting the particle size of the particles, an average particle size may be used. By selecting, for example, many first particles (group) having an average particle size within a range of 10 nm or more to 50 nm or less and many second particles (group) having an average particle size within a range more than 50 nm to less than 110 nm, a combination of particles having two particle sizes in the invention can be formed.

Examples of the surface treatment particles include inorganic particles and organic particles. Examples of the inorganic particles include colloidal silica particles, alumina particles, and titanium oxide particles. Examples of the organic particles include particles made of a resin having a melting temperature or softening temperature higher than a fixing temperature and capable of keeping a solid state at the fixing temperature.

[Composition of Surface Treatment Agent]

The surface treatment agent can be prepared using at least the surface treatment particles and a liquid medium for dispersing the particles therein. Examples of the liquid medium for dispersing the surface treatment particles therein include a water-based liquid medium for ink preparation.

The surface treatment agent can be used after its surface tension or viscosity is adjusted as needed by adding a surfactant or viscosity regulator thereto. As the surfactant or viscosity regulator, those capable of adjusting the surface tension or viscosity into an intended one can be used. Examples of the surfactant include Acetylenol E100 (trade name; product of Kawaken Fine Chemicals).

The content of the surface treatment particles in the surface treatment agent having, as the surface treatment component, only the surface treatment particles and to be used in combination with the film forming resin incorporated in the ink is preferably 0.1 mass % or more to 1 mass % or less.

The content of the surface treatment particles in the surface treatment agent having, as the surface treatment component, both the surface treatment particles and the film forming resin is preferably 0.1 mass % or more to 1 mass % or less and the content of the film forming resin is preferably 0.1 mass % or more to 1 mass % or less.

When the surface treatment agent contains both the surface treatment particles and the film forming resin, a ratio (mass ratio) of the film forming resin to the second particles capable of giving a porosity of about 26%, which is a volumetric porosity when the second particles are arranged with the highest density, is preferred. This permits orderly arrangement of the large particle size particles. Further, in consideration of combined use of the first particles and the second particles, using the film forming resin at a ratio ranging from 0.1 or more to 1 or less is preferred for forming a substantially good film state supposing that a ratio of the second particles is 1.

The content of the surface treatment particles in the first surface treatment agent of the two-component type surface treatment agent is preferably 0.1 mass % or more to 1 mass % or less. The content of the film forming resin in the second surface treatment agent of the two component type agent is preferably 0.1 mass % or more to 1 mass % or less. Also with respect to a ratio (mass ratio) of the film forming resin to the surface treatment particles in the two-component type surface treatment agent, using the film forming resin at a ratio a range of 0.1 or more to 1 or less is preferred supposing that a ratio of the second particles is 1.

[Method of Adding Surface Treatment Agent]

A method of adding the surface treatment agent to the recording medium is not particularly limited. Various methods can be adopted including an ejection method using an ink jet recording head, an application method using various systems and a method of carrying out planar transfer of a thin layer.

In the method making use of an ink jet recording head, an addition amount of the surface treatment agent can be changed according to an area when expression of a difference in gloss on the same plane is intended. In the two-component type surface treatment agent, ejection by two ink jet recording heads may be utilized to add the first surface treatment agent and the second surface treatment agent, respectively.

<Removal of Liquid Component>

After formation of an image on the recording medium, it is also preferred to provide a step of decreasing the content of a liquid component (mainly water or a volatile liquid component when a water-based ink is used) of the image and an apparatus for the step. A too much liquid component of the image may protrude or overflow in the fixing step performed subsequently, disturb the image, and cause a fixing failure. Further, it may be a cause of image disturbance.

As a method of removing the liquid component from the image, various methods so far used for drying and fixing the image formed with an ink can be used. Examples include a method using heating, a method of sending low-humidity air, a method of reducing a pressure and a combination of them. The liquid content can also be removed by natural drying. The liquid content removal step may be performed as a part of heating of the image which will be described later.

Decreasing the content of the liquid component from image-forming ink droplets on the recording medium on which an image is to be formed causes aggregation of the component in the ink, and facilitates formation of an ink aggregation layer.

<Heater>

An image is heated on a recording medium to integrally form, into a film, the surface treatment particles added to the image for surface treatment and the film forming resin. No particular limitation is imposed on a heater to be used for heating for this film formation insofar as it is capable of intended heat treatment. For example, a heater adopting a system of directly heating an image or a heater adopting a system of heating an image indirectly from the back surface of the recording medium can be used. Using these heaters having respectively different systems in combination is more preferred. Examples of the heater include a hot-air blower such as fan heater, a warm-air drier, an infrared heater, a flash fixer and a heat generator such as halogen heater. Alternatively, an electromagnetic induction heating system heater may be used which has a recording medium conveying support member comprised of a material such as metal capable of electromagnetic induction heating.

The image is heated preferably by irradiating a recording medium with infrared light. This infrared irradiation may be used also for drying the image.

Of the heaters described above, an infrared heater that irradiates a recording medium itself with infrared light for heating is preferred.

In a method of heating the recording medium while transferring it toward the heater, a heating time of the image-forming ink layer often becomes short. Particularly when high-speed image formation is performed, a decrease in the heating time of the ink layer is marked. In order to achieve improved fixing of the image, on the other hand, the surface of the recording medium should be heated to make the temperature of the image high. A heating method for quickly increasing the temperature of the image on the recording medium in a short time is therefore preferred. Using an infrared heating method enables quick increase of the temperature of the image on the recording medium in a short time. This heater for film formation may also be used for the above-described treatment of removing (drying) the liquid component from the image. By using a common heater as described above, drying of the image, formation of the ink aggregation layer, and even film formation of the surface treatment agent layer can be performed by this common heater. The heater preferably has a constitution permitting change of a heating temperature depending on the softening temperature or melting temperature of the film forming resin. This heater may be used also for the heat treatment for heating the image to a fixing temperature in a fixing step which will be described later.

<Fixing Unit>

As a fixing unit, a known fixing unit can be used. For example, fixing units having various systems such as a heat and pressure roller system, a roller nip system and an endless press system can be used.

In the fixing step, a pressure treatment of the image is performed by fixing, by applying a pressure, a fixing member onto a softened image on a recording medium heated to a fixing temperature or a heat and pressure treatment of the image is performed by fixing, by applying a pressure, a fixing member onto an un-softened image on a recording medium not heated to the fixing temperature while heating the image. Thus, an image printed product is obtained. Pressure application from both sides, that is, from the sides of the fixing member and the recording medium by means of a pressure roller is preferred because the image can be fixed to the recording medium efficiently.

The heater and the fixing unit may be integrated into a heat and pressure fixing unit like a heat pressure roller system fixing unit. When the heat and pressure fixing unit is used, heating of an image before contact with the fixing member is not required.

In the final stage of the fixing step, the fixing member is released from the recording medium having an image thereon and an image printed product is formed as an end product.

Heating of the image in the fixing step facilitates not only formation of the film forming resin into a film but also softening of the image due to an increase in the temperature of the image on the recording medium. By this heating, the image is softened sufficiently and stickiness to the recording medium is enhanced.

Fixing of the image onto the recording medium under such a state by applying a pressure thereto enhances the contact property with the recording medium and reinforces the adhesive force because an ink aggregation product to be brought into contact with the recording medium is soft. On the surface of the image on the side of the fixing member, on the other hand, the contact property between the film formed by the film forming resin and the surface of the fixing member deteriorates due to the presence of the surface treatment particles. As a result, releasability of the fixing member from the image is improved, which enables smooth release in the release step.

The pressure applied at the time of fixing by the pressure treatment is preferably 5 $kgf/cm^2$ or more. Such a pressure makes uniform the arrangement of the surface treatment particles on the interface with the fixing member and improves releasability and improves glossiness while accelerating smoothening.

Figure 5:
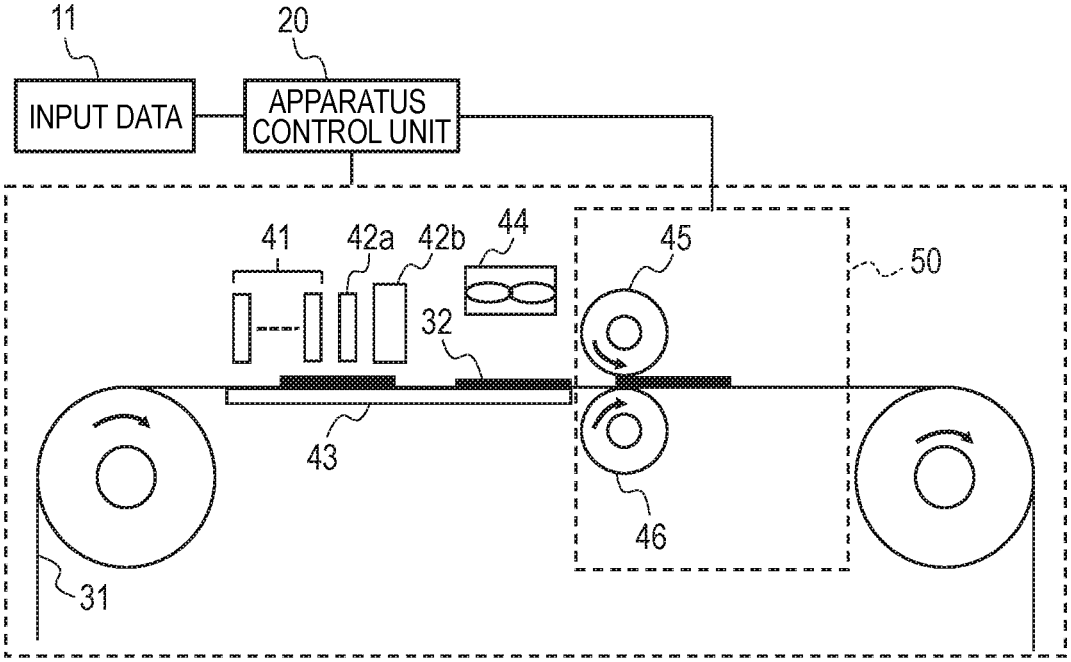
FIG. 5 is a schematic view showing the constitution of an ink jet recording apparatus usable in the ink jet recording method according to the one embodiment of the invention.

In an apparatus as shown in FIGS. 1 and 5 having a heater and a fixing unit separately and conveying an image heated to the fixing temperature to the fixing unit, the heat capacity of the surface layer of the fixing member is preferably as small as possible at the time of contact between the fixing member and a recording medium during fixing. By decreasing the heat capacity of the surface layer of the fixing member, the surface layer of the fixing member is deprived of its heat due to heat conduction to the support member side of the recording medium via the recording medium and the temperature of the surface layer of the fixing member decreases drastically. This causes a drastic reduction in temperature of the image, followed by enhancement in the aggregation force of the image, which also contributes to easy release of the image from the fixing member and improvement in releasability.

Figure 6:
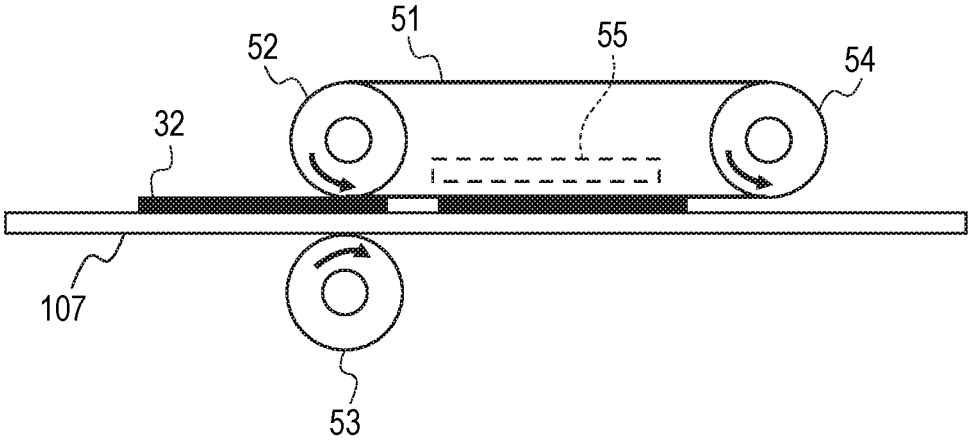
FIG. 6 is a schematic view showing the constitution of a fixing unit of the ink jet recording apparatus usable in the ink jet recording method according to the one embodiment of the invention.

In the apparatus having the constitution as shown in FIGS. 1, 5 and 6, the release temperature can be set low by adjusting the temperature at the time of the fixing step and providing a temperature difference between the fixing temperature and the release temperature. Such a temperature control is also effective for more smooth release of the fixing member. Temperatures lower than the softening temperature or melting temperature of the film forming resin facilitate release of the fixing member because the resin becomes hard and its adhesive force to the fixing member lowers while keeping the smoothness of the surface of the image.

Further, since the adhesive force between the surface of the image and the fixing member can be reduced by the addition of the surface treatment particles, the fixing member can be released at a temperature higher than that in the case where the surface treatment particles are not added.

Surface energy at a contact portion of the fixing member with the image may be selected as needed to enable the fixing member to be released from the image while keeping the quality of the image without causing collapse of the shape of the image at the time of fixing. The surface energy of the fixing member is preferably 40 (mN/m) or more.

The contact portion between the fixing member and the image has preferably a surface roughness (Ra) of 0.1 μm or less.

The surface treatment agent contains, as the surface treatment particles, a combination of first particles and second particles different in particle size so that large-particle size particles 1 and small particle size particles 2, for example, as shown in FIG. 2B are arranged densely on the surface of the surface treatment agent layer after the pressure treatment of the fixing member. With respect to the surface under such a state, the surface of the resin film 4 present in a space between the particles of the large particle size particles 1 and the small particle size particles 2, particularly, between the large particle size particles 1 has a surface roughness corresponding to the surface of the contact portion of the fixing member. Supposing that the large particle size particles 1 have a particle size less than 110 nm, an optically smoother surface is formed when the contact portion of the fixing member with the image has a surface roughness Ra of 0.1 μm or less. At this time, the recess of the surface of the image has a depth of about 40 nm or less when the large particle size particles 1 have a particle size of 110 nm and the small particle size particles 2 have a particle size of 50 nm and it has a depth of from about 10 to 20 nm when the large particle size particles 1 have a particle size of 100 nm and the small particle size particles 2 have a particle size of from 10 to 20 nm.

FIG. 2A shows the emulsion resin particles 3 before melting. Thus, by making the particle size of the emulsion resin particles 3 smaller than that of the large particle size particles 1, they are likely to enter a space between the large particle size particles 1 and the surface as described above can be formed easily. The reason of it will next be described.

The emulsion resin particles 3 having a particle size larger than that of the large particle size particles 1 easily form adhesion between the emulsion resin particles 3. Adhesion between the emulsion resin particles 3 before they flow into the space of the large particle size particles 1 prevents uniform dispersion of the large particle size particles 1 and the emulsion resin particles 3, leading to formation of too many voids or difficulty in formation of a smooth surface.

The image is heated to the fixing temperature preferably by an infrared heater that heats the image on the recording medium by exposure to infrared light. This heating contributes not only to the above-described film formation but also to an increase in the temperature of the image on the recording medium to facilitate softening of the image. Thus, the image is softened by heat sufficiently and adhesiveness to the recording medium is enhanced.

The image formation conditions to be used in the ink jet recording method of the invention will be described in further detail by showing examples of them in Examples later.

<Ink Jet Recording Apparatus>

An apparatus usable in the ink jet recording method of the invention will hereinafter be described.

FIG. 1 is a schematic view showing one example of an ink jet recording apparatus.

The ink jet recording apparatus shown in FIG. 1 has an input data processing unit 11, an apparatus control unit 20 for controlling the operation of the apparatus based on the input data, a reaction liquid addition unit for adding a reaction liquid, an ink addition unit, a surface treatment agent addition unit, a recording medium support member 43, a heating drier 44 and a fixing unit 50.

The ink addition unit has an ink jet recording head 41 for adding an ink and the surface treatment agent addition unit has an ink jet recording head 42 for adding a surface treatment agent. The fixing unit 50 is a roller nip system fixing unit having a pair of rollers 45 and 46 and the roller 45 functions as a fixing roller.

In the illustrated example, a conveying system of a recording medium is shown which conveys a long recording medium wound in roll form from a delivery roller (not illustrated) to a winding roller (not illustrated). A recording medium 31 and a conveying system thereof are not limited to the illustrated example. For example, a sheet type recording medium having a predetermined size and a conveying system thereof may be used. The material of the recording medium 31 is also not particularly limited and a recording medium made of various materials such as paper and plastic film can be used.

Image formation can be performed by the following steps (1) to (4) by using the apparatus shown in FIG. 1.

(1) A reaction liquid adding step: a reaction liquid is added onto a recording medium.

(2) An ink adding step: next, an ink is added onto the recording medium to which the reaction liquid has been added.

(3) A surface treatment agent adding step: after addition of the ink onto the recording medium to which the reaction liquid has been added, a surface treatment agent is added to form a surface treatment agent-added image on the recording medium.

(4) A fixing step: the image is fixed onto the recording medium by heating the recording medium and the image, removing a liquid component from the image, increasing the temperature of the image and applying a pressure to the image by means of a fixing member and then the fixing member is released from the image.

The above-described steps (1) to (4) will next be described in detail, referring to each unit of the image formation apparatus shown in FIG. 1.

In the apparatus shown in FIG. 1, as the reaction liquid addition unit, a roller type application unit (not illustrated) is placed which is capable of placing a reaction liquid application roller so as to come into contact with the surface of the recording medium. This unit adds a reaction liquid continuously to the image formation surface of the recording medium (reaction liquid adding step).

Next, from the ink jet recording head 41, an ink for image formation is ejected (ink adding step). By this step, the recording medium 31 has thereon an image including an ink aggregation product obtained by the reaction between the reaction liquid and the ink.

Next, from the ink jet recording head 42 placed to face the image-having surface of the recording medium, a surface treatment agent is ejected (surface treatment agent adding step). The apparatus shown in FIG. 1 uses an ink jet recording head that uses an electro-thermal converter and carries out ink ejection by an on-demand system.

As the heating drier 44, a heating drier having an infrared irradiator (not illustrated) and a blower placed to face the image formation surface of the recording medium is used and the surface treatment agent-added image on the recording medium is heated and dried. This decreases a liquid content in the image on the recording medium to dry the image and softens or melts a film forming resin content in the image.

The heated and dried image is conveyed to the roller nip type fixing unit 50 not having a heater and fixed to the recording medium 31 by a pressure treatment with a fixing roller 45. The fixing roller 45 is then released from the image fixed to the recording medium 31 when the recording medium is taken out from a nip unit comprised of the roller pair (fixing step).

In the apparatus shown in FIG. 1, one unit serves both as a drier and as a fixing heater from the standpoint of size reduction of the apparatus. The infrared irradiator and the blower are provided as one integrated unit in FIG. 1, but the infrared irradiator and the blower may be provided as two units used in combination. Drying and heating may be performed by respective units from the standpoint of separating the drying treatment function from the heating treatment one.

As described above, a smooth release effect of the fixing member can be obtained also by providing a difference between the fixing temperature (for example, the temperature at the time of heating and drying the image) and the releasing temperature by a temperature adjustment at the time of fixing and releasing and thereby decreasing the release temperature. A temperature lower than the softening or melting temperature of the film forming resin facilitates the release of the fixing member because the resin becomes hard and the adhesive force to the fixing member decreases while keeping smoothness of the surface of the image.

Further, since the addition of the surface treatment particles can reduce the adhesive force to the fixing member, the fixing member can be released at a temperature higher than that in the case where the surface treatment particles are not added.

When the fixing unit has a heater, sufficient heating of the image is not always necessary until the fixing step. In this case, the image is preferably dried prior to conveyance into the fixing unit and heating up to the fixing temperature is not required.

When a roller nip type fixing unit having a heater is used, a short nip time for fixing in high-speed image formation can be made up for by increasing the temperature of the fixing roller.

FIG. 5 shows a constitution of another embodiment of an ink jet recording apparatus. The apparatus shown in FIG. 5 has a constitution similar to that of FIG. 1 except that two ink jet recording heads 42*a* and 42*b* for adding two components of a two-component type surface treatment agent to the recording medium 31, respectively, are provided successively from the upstream side to the downstream side of the traveling direction of the recording medium.

FIG. 6 shows another embodiment of a fixing unit.

The fixing unit shown in FIG. 6 is an endless press type fixing unit. This fixing unit has an endless belt 51 as a fixing member, a pair of rollers 52 and 53, a roller 54 for suspending the endless belt 51 which roller is used together with the roller 52 and a cooler 55. The roller 52 is a heating roller having a heater.

In this fixing unit, heat and pressure are applied to a surface treatment agent-added image 32 on a recording medium 107 by the heating roller 52 and the pressure roller 53 and the surface of the image 32 changes its shape along the surface shape of the endless belt 51. The deformed image is cooled by the cooler 55, passes the set position of the roller 54 and is taken out of the apparatus. At this time, the endless belt 51 is released from the surface of the image 32.

The fixing unit shown in FIG. 6 can be used as the fixing unit 50 of the apparatus shown in FIG. 1 and FIG. 5. When this fixing unit is used, the heating roller 52 can heat the image to the fixing temperature so that the image formation apparatus is not required to have the heating drier 44 shown in FIGS. 1 and 5.

The invention makes it possible to provide an ink jet recording method capable of releasing a fixing member from an image stably in a fixing step for imparting an image with gloss.

EXAMPLES

The ink jet recording method of the invention will next be described more specifically by Examples. The invention is not limited by the following examples insofar as it does not depart from the gist of the invention. All the designations of "part" or "parts" and "%" mean part or parts by mass and mass %, respectively unless otherwise particularly specified.

Preparation Example 1

[Reaction Liquid]

The components described below were mixed and sufficiently stirred. The resulting mixture was pressure filtered through a Micro Filter (product of Fujifilm) having a pore size of 3.0 μm and the resulting filtrate was collected as a reaction liquid.

Levulinic acid: 40 parts
Glycerin: 5 parts
Surfactant: 1 part (trade name; Acetylenol E100, product of Kawaken Fine Chemicals)
Resin fine particles: polyacrylic acid: 3 parts
Ion exchanged water: 51 parts

[Ink]

(Preparation of Black Pigment Dispersion)

After 10% of carbon black (Monarch 1100, trade name; product of Cabot Corporation), 15% of an aqueous solution of a pigment dispersion (a styrene-ethyl acrylate-acrylic acid copolymer <acid value: 150, weight-average molecular weight: 8,000>; solid content: 20%; already neutralized with potassium hydroxide) and 75% of pure water were mixed, the resulting mixture was charged in a batch-system vertical sand mill (product of Aimex). The sand mill was filled with 200% of zirconia beads having a diameter of 0.3 mm. While cooling with water, a dispersion treatment was performed for 5 hours. The resulting dispersion was treated by a centrifuge and coarse particles were removed to obtain a black pigment dispersion having a pigment concentration of about 10%.

(Preparation of Cyan Pigment Dispersion)

In a manner similar to that used in the preparation of a black pigment dispersion except that 10% of the carbon black used for the preparation of the black pigment dispersion was replaced by 10% of C.I. Pigment Blue 15:3, a cyan pigment dispersion was prepared.

(Preparation of Magenta Pigment Dispersion)

In a manner similar to that used in the preparation of a black pigment dispersion except that 10% of the carbon black used for the preparation of the black pigment dispersion was replaced by 10% of C.I. Pigment Red 122, a magenta pigment dispersion was prepared.

(Preparation of Yellow Pigment Dispersion)

In a manner similar to that used in the preparation of a black pigment dispersion except that 10% of the carbon black used for the preparation of the black pigment dispersion was replaced by 10% of C.I. Pigment Yellow 74, a yellow pigment dispersion was prepared.

(Preparation of Resin Fine-Particle Dispersion)

Butyl methacrylate (18%), 2% of 2,2'-azobis-(2-methylbutyronitrile) and 2% of n-hexadecane were mixed and the resulting mixture was stirred for 0.5 hour. The resultant mixture thus obtained was added dropwise to a 6% aqueous solution of an emulsifier NIKKOL BC15 (trade name; product of Nikko Chemicals) (added at 78%), followed by stirring for 0.5 hour. Then, the resultant mixture was exposed to ultrasonic waves for 3 hours by using an ultrasonic irradiator. After a polymerization reaction at 80° C. for 4 hours in a nitrogen atmosphere and cooling to a room temperature, the resultant mixture was filtered to obtain a resin fine-particle dispersion having a concentration of about 20%. The resulting resin fine particles had a weight-average molecular weight of from about 1,000 to about 2,000,000 and a disperse particle size of from about 100 nm to about 500 nm. The resin fine particles had a minimum film forming temperature of from 100 to 120° C. and a glass transition temperature (Tg) of from 70 to 80° C.

(Preparation of Ink)

<Preparation of Ink 1>

Black, cyan, magenta and yellow inks each having the following composition were prepared. More specifically, components were mixed according to the following formulation and stirred sufficiently. Then, the resultant mixture was pressure filtered through a Micro Filter (Product of Fujifilm) having a pore size of 3.0 μm to prepare an ink 1.

(Composition of Ink 1)

- Any one of the above-described pigment dispersions having respective colors (concentration: about 10%): 20%
- The above-described resin fine-particle dispersion (concentration: about 20%): 50%
- Glycerin: 12%
- Acetylenol EH (trade name; product of Kawaken Fine Chemicals): 0.5%
- Pure water: 17.5%

<Preparation of Ink 2>

- Any one of the above-described pigment dispersions having respective colors (concentration: about 10%): 20%
- The above-described resin fine-particle dispersion (concentration: about 20%): 46%
- Styrene-acrylic copolymer, resin emulsion (average particle size: 60 nm): 4% (minimum film forming temperature (MFT): 70° C., glass transition temperature (Tg): 40° C.)
- Glycerin: 12%
- Acetylenol EH (trade name; product of Kawaken Fine Chemicals): 0.5%
- Pure water: 17.5%

[Surface Treatment Agent]

(Preparation Example 1 of Surface Treatment Agent)

Surface treatment agent liquids 1 and 2 having the following compositions, respectively, were prepared. More specifically, after the below-described components were mixed and the resulting mixture was stirred sufficiently, the resultant mixture was pressure filtered through Micro Filter (product of Fujifilm) having a pore size of 3.0 μm to prepare surface treatment agent liquids 1 and 2.

Composition of Surface Treatment Agent Liquid 1:

- Styrene-acrylic copolymer, resin emulsion: 1% (average particle size: about 100 nm) (minimum film forming temperature (MFT): 75° C.)
- Glycerin: 12%
- Acetylenol EH (trade name; product of Kawaken Fine Chemicals): 0.5%
- Pure water: balance Composition of Surface Treatment Agent Liquid 2:

- Large particle size silica Snowtex ZL (trade name; product of Nissan Chemical) (average particle size: 100 nm): 0.5%
- Small particle size silica Snowtex N (trade name; product of Nissan Chemical) (colloidal silica) (average particle size: from 10 to 20 nm): 0.25%
- Glycerin: 12%
- Acetylenol EH (trade name; product of Kawaken Fine Chemicals): 0.5%
- Pure water: balance (Preparation Example 2 of Surface Treatment Agent)

A surface treatment agent liquid 3 having the following composition was prepared as in Preparation example 1 of surface treatment agent.

Composition of Surface Treatment Agent Liquid 3:

- Large particle size silica Snowtex ZL (trade name; product of Nissan Chemical) (average particle size: 100 nm): 0.5%
- Small particle size silica Snowtex N (trade name; product of Nissan Chemical) (average particle size: from 10 to 20 nm): 0.3%
- Styrene-acrylic copolymer, resin emulsion (average particle size: 60 nm): 1% (minimum film forming temperature (MFT): 70° C.)
- Glycerin: 12%
- Acetylenol EH (trade name; product of Kawaken Fine Chemicals): 0.5%
- Pure water: balance (Preparation Example 3 of Surface Treatment Agent)

A surface treatment agent liquid 4 having the following composition was prepared as in Preparation Example 1 of surface treatment agent.

Composition of Surface Treatment Agent Liquid 4:

- Large particle size silica Snowtex ZL (trade name; product of Nissan Chemical) (average particle size: 100 nm): 0.5%
- Small particle size silica Snowtex N (trade name; product of Nissan Chemical) (average particle size: from 10 to 20 nm): 0.3%
- Water soluble resin (minimum film forming temperature (MFT): 70° C.): 1%
- Glycerin: 12%
- Acetylenol EH (trade name; product of Kawaken Fine Chemicals): 0.5%
- Pure water: balance (Preparation Example 4 of Surface Treatment Agent)

A surface treatment agent liquid 5 having the following composition was prepared as in Preparation Example 1 of surface treatment agent.

Composition of Surface Treatment Agent Liquid 5:

- Large particle size silica Snowtex ZL (trade name; product of Nissan Chemical) (average particle size: 100 nm): 0.5%
- Small particle size silica Snowtex N (trade name; product of Nissan Chemical) (average particle size: from 10 to 20 nm): 0.3%
- Glycerin: 12%
- Acetylenol EH (trade name; product of Kawaken Fine Chemicals): 0.5%
- Pure water: balance

Example 1

The present Example uses a two-component type surface treatment agent.

An image was formed on a recording medium under the following conditions by using the reaction liquid and ink prepared in Preparation Example 1, the surface treatment agent liquids 1 and 2 prepared in Preparation Example 1 of surface treatment agent and an ink jet recording apparatus having the constitution as shown in FIG. 5.

As the fixing roller 45, that having a polyimide surface layer (Kapton, trade name; product of DuPont-Toray) on a base made of SUS and having a surface roughness Ra of 20 nm and surface energy of 48 (mN/m) was used. A contact portion of the fixing roller (fixing member) with the image has preferably an elastic modulus of 3 GPa or more. For example, it can be selected from 3 to 7 GPa and in the present Example, it is set at 5 GPa.

Fixing can be performed at a fixing roller temperature of from 80 to 150° C., an applied pressure of 10 kg/cm' and a nip time of from 20 to 600 ms.

When heating is performed mainly by infrared (IR) radiation, the temperature of an ink image can be increased to about 120° C. so that the fixing roller temperature is set at 80° C. and a nip time is set at 100 ms. Heating and drying only with hot air without using infrared (IR) radiation is performed at a fixing roller temperature of 150° C. and a nip time of 100 ms.

As the recording medium, cast coated paper is preferred because it has higher smoothness in paper whiteness than that of gloss coated paper and provides the image with higher gloss. Examples of the cast coated paper include Gloria Pure White (trade name; product of Gojo Paper MFG: 210 gsm paper) and Mirror coat paper (trade name; product of Oji Paper, basis weight: 127.9 g/m$^2$). In the present Example, 210 gsm paper of Gloria Pure White (trade name; product of Gojo Paper MFG) was used.

In the present Example, the recording medium was set at a predetermined position and an image was formed by the following steps.

A predetermined amount of the reaction liquid was applied to the surface of the recording medium 31 by an application roller (not illustrated). Then, an image was formed by ejecting at least one of pigment inks selected from black, cyan, magenta and yellow from an ink jet recording head 41 to an image formation surface which had reached the set position of the ink jet recording head 41. To the image formation surface of the recording medium 31 which had reached the respective set positions of ink jet recording heads 42*a* and 42*b*, the surface treatment agent liquid 1 was ejected from the ink jet recording head 42*a* and the surface treatment agent liquid 2 was ejected from the ink jet recording head 42*b*. By these steps, the image forming pigment ink reacted with the reaction liquid applied in advance to the surface of the recording medium to form an ink aggregation layer.

Next, when the image 32 reached a heater 44, a nonvolatile component such as water was removed by drying treatment and at the same time, the ink aggregation layer was heated. The ink aggregation layer was heated to reach 120° C., a temperature higher than the film forming temperature of the emulsion resin particles given by the surface treatment agent liquid 1, and it was, together with silica particles, formed into a film. Thus, the image was fixed.

When the image reached the position of the fixing roller 45 in the fixing unit 50, the image came into contact with the fixing roller 45 of 80° C. in a nip time of 100 ms and the image having a smoothened surface was fixed onto the recording medium 31. The image fixed onto the recording medium 31 was separated from the fixing roller and was then taken out from the fixing unit 50.

In the present Example, an image with high gloss and smooth releasability was obtained.

Observation of the surface of the image using an atomic force microscope (AFM) revealed that spherical silica particles having a diameter of from about 10 to 20 nm were arranged densely and fixed on the underlying resin film layer with a portion of them being exposed from the surface layer.

(Evaluation)

Measurement Method of Smoothness

Image smoothness when a recording medium having high smoothness such as coated paper is used is measured using an image clarity meter ("ICM-IT", trade name; product of Suga Test Instruments). Image clarity C(2) (%) at the time when an optical comb has a width of 2 mm is used here as the value of image clarity and the image clarity of 30 or more means that the upper most layer of the image has a smoothened surface.

Measurement Method of Glossiness

The reflected light intensity of the image on the recording medium is evaluated by a 20° gloss meter ("VG7000", trade name; product of Nippon Denshoku).

Measurement Method of Unevenness

Unevenness of a layer with minute unevenness is measured using a scanning electron microscope ("S-4800", trade name; product of Hitachi Hi-technologies). The height of unevenness means a height, in the longitudinal cross-sectional direction, of the outermost layer of the layer with minute unevenness between the top portion and the bottom portion. Ten longitudinal cross-sectional surfaces of unevenness are observed using an electron microscope and an average of the measured values is calculated. Alternatively, unevenness may be checked by measuring a plane by using AFM.

(Evaluation Results)

The surface of the image had high smoothness with the depth of unevenness within a range of from about 10 to 20 nm (refer to FIGS. 3A to 3C), suggesting that the surface had good glossiness. The gloss value was, as 20° gloss value, 80 and the image clarity was 28.

Example 2

The present Example is an example of using a surface treatment agent containing both silica particles having two respectively different particle sizes and emulsion resin particles.

The apparatus shown in FIG. 1 was used, but the drying step was performed using not IR heating but only hot air. The temperature of the fixing roller 45 was set at 150° C. In the present Example, a surface treatment agent liquid 3 was used as the surface treatment agent and it was added to the image formation surface of the recording medium 31 by the ink jet recording head 42. As in Example 1 except for the use of the above-described conditions, formation and fixing of an image were performed.

The image obtained finally in the present Example had improved smoothness, better releasability at the time of fixing and had higher gloss compared with an image formed using one-particle-size silica particles for comparative investigation. It had a gloss value, as 20° gloss value, of 75 and an image clarity of 26.

Observation of the surface of the image under AFM revealed that spherical silica particles having a particle size (diameter) of about 100 nm were arranged densely with most of them being buried in the film made of the emulsion resin particles and some protruding from the film. When the image was observed from the surface, the film made of the emulsion resin particles was observed between the large particle size silica particles and the spherical silica particles having a particle size (diameter) of from about 10 to 20 nm attached to the surface layer of the film. Observation of the cross-section by SEM showed that silica particle spheres having a diameter of from about 10 to 20 nm attached to the surface layer of the emulsion. The surface unevenness had a depth of about 20 nm.

Figure 4A:
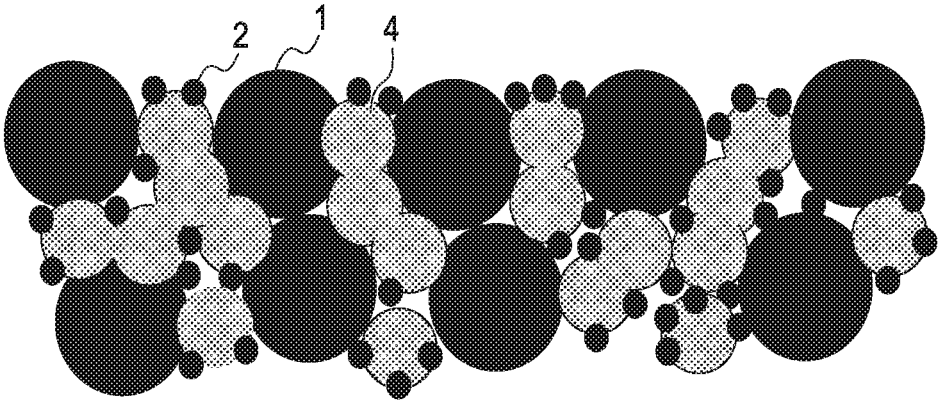
FIGS. 4A and 4B are each a schematic view showing the surface and cross-section, after the fixing step, of the surface treatment liquid layer formed on the recording medium in the one embodiment of the invention.
Figure 4B:
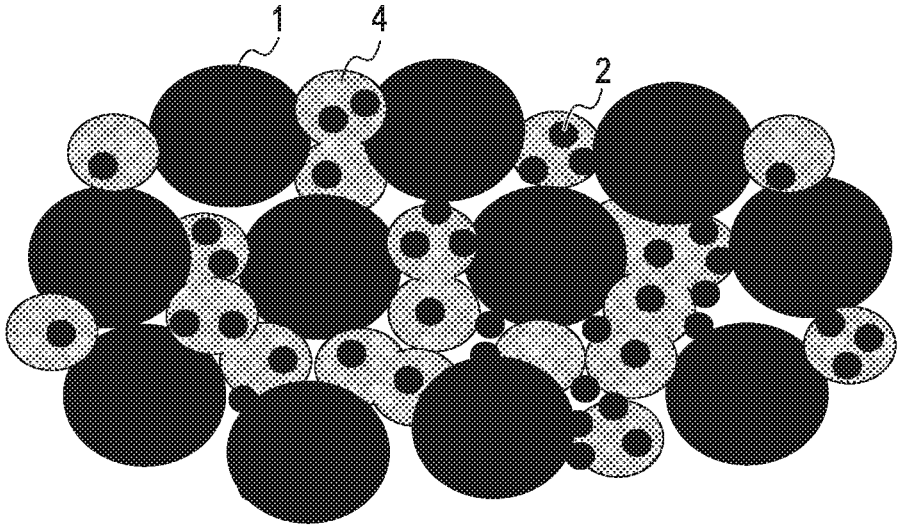

The cross-section and the surface of the surface treatment agent layer in the fixed image formed in the present Example are schematically shown in FIG. 4A and FIG. 4B, respectively.

Example 3

The present Example is an example of using a surface treatment agent containing both silica particles having two respectively different particle sizes and a water-soluble resin. Although the apparatus shown in FIG. 1 was used, the drying step was performed using not IR heating but only hot air and the temperature of the fixing roller 45 was set at 150° C.

In the present Example, the surface treatment agent liquid 4 was used as a surface treatment agent and is applied to an image formation surface of the recording medium 31 by the ink jet recording head 42. Formation and fixing of an image were performed in a manner similar to that of Example 2 except for the use of the above-described conditions.

The image obtained finally in the present Example had improved smoothness, good releasability at the time of fixing and high gloss. It had a gloss value, as 20° gloss value, of 70 and an image clarity of 27. The unevenness of the surface had a depth of about 20 nm.

Example 4

The present Example is an example of adding emulsion resin particles not to a surface treatment agent but to an ink and adding silica particles having two respectively different average particle sizes to the surface treatment agent.

The present Example used, as an ink, an ink 2 further containing an emulsion resin (minimum film-forming temperature (MFT): 70° C., average particle size: 60 nm) that softens in the fixing step.

Although the apparatus shown in FIG. 1 was used, the drying step was performed using not IR heating but only drying with hot air. The temperature of the fixing roller 45 was set at 150° C.

The surface treatment agent liquid 5 not containing emulsion resin particles was used as a surface treatment agent. Formation and fixing of an image were performed in a manner similar to that of Example 2 except for the use of the above-described conditions.

As a result, a recorded image had no disorder and due to good release from the fixing roller at the time of fixing, an image having a smooth surface and high gloss was output.

It had a gloss value, as 20° gloss value, of 70 and an image clarity of 25. The unevenness of the surface had a depth of about 35 nm.

Example 5

The present Example uses an apparatus having a constitution similar to that of FIG. 1 except that a fixing unit shown in FIG. 6 is used as the fixing unit 50.

Formation and fixing of an image were performed using the apparatus shown in FIG. 1 and in a manner similar to Example 2 except that the surface treatment liquid 3 was used as the surface treatment agent and the fixing unit shown in FIG. 6 was used as the fixing unit under the below-described conditions.

The fixing step using the fixing unit shown in FIG. 6 was performed as follows.

A release temperature is set low by adjusting the temperature at the time of fixing and releasing step and providing a temperature difference between the fixing temperature and the releasing temperature. The endless press type fixing unit shown in FIG. 6 applies heat and pressure to an ink image 32 formed on a recording medium 107 by means of a heating roller 52 and a pressure roller 53 to change the shape of the image 32 along the surface shape of the endless belt serving as a fixing member. As an endless belt 51 as the fixing member, used was a belt made of polyimide (Kapton; product of DuPont-Toray) and having a surface roughness Ra of 20 nm and a surface energy of 48 (mN/m). It had an elastic modulus of 5 GPa.

The pressure applied was 10 Kg/cm$^2$.

The temperature of the heating roller 52 was set at 150° C. to adjust the temperature of the image 32 to about 120° C. The release temperature was adjusted using a cooling unit 55.

The release temperature was adjusted to fall within a range of from 25° C. to 120° C. and glossiness and releasability were evaluated.

The releasability was evaluated by measuring, in order to measure the release force at the fixed state, the release force by a low-weight type adhesion/film release analyzer VPA-3, product of Kyowa Interface Science, by changing a temperature while keeping a contact between the fixing member and the image.

The release force of 0.1 N or less was rated as "A", that more than 0.1 N and 0.2N or less was rated as "B", that more than 0.2N and 0.5N or less was rated as "C" and that more than 0.5N was rated as "D". The glossiness was evaluated using a 20° gloss value. That of 70 or more was rated as good, while image clarity of 25 or more was rated as good. The depth of the surface unevenness was measured by AFM and that of 40 nm or less was rated as good.

Evaluation results are shown in Table 1.

As shown in Table 1, glossiness and releasability are sufficient at 25° C. Even at 80° C., there is almost no change in effect. At from 100 to 120° C., results are satisfactory in spite of slight deterioration in glossiness and releasability. Even compared with the results obtained in Comparative Examples shown below, sufficient glossiness and releasability are both achieved.

TABLE 1

| | Release temperature (° C.) | | | | |
|---|---|---|---|---|---|
| | 25 | 50 | 80 | 100 | 120 |
| Releasability | A | A | A | B | B |
| Glossiness | 80 | 77 | 74 | 72 | 70 |
| Image clarity | 28 | 27 | 26 | 25 | 25 |
| Depth of surface unevenness (nm) | 20 | 20 | 20 | 30 | 40 |

Comparative Example 1

In a manner similar to that of Example 5 except that a surface treatment agent was not used, formation and fixing of an image were performed. Results of evaluation of glossiness and releasability performed as in Example 5 are shown in Table 2.

As shown in Table 2, the releasability at the release temperature of 25° C. is rated as "B", a 20° gloss value is 80, and an image clarity is 25, but at the release temperature of 50° or more, releasability is insufficient, leading to deterioration in glossiness and image clarity. At 80° C. or more, the image stuck to the fixing member so that the glossiness was not measured.

TABLE 2

| | Release temperature (° C.) | | | | |
|---|---|---|---|---|---|
| | 25 | 50 | 80 | 100 | 120 |
| Releasability | B | C | D | D | D |
| Glossiness | 80 | 40 | — | — | — |
| Image clarity | 25 | 15 | — | — | — |
| Depth of surface unevenness (nm) | 40 | 150 | — | — | — |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-030887, filed Feb. 23, 2018, which is hereby incorporated by reference herein in its entirety.

What is claimed is:

1. An ink jet recording method, comprising:

an image forming step for adding an ink containing a pigment as a coloring material to a recording medium to form an image;

a surface treatment agent adding step for adding a surface treatment agent for modifying a surface of the image to the image formed on the recording medium; and a fixing step for heating the surface treatment agent-added image to a fixing temperature, bringing a fixing member into contact with the image and applying a pressure thereto, and then releasing the fixing member from the image to fix the image to the recording medium, wherein:

at least one of the ink and the surface treatment agent contains a resin that melts or softens at the fixing temperature;

the surface treatment agent contains at least two kinds of particles different in particle size that do not melt at the fixing temperature; and the particles contain first particles and second particles having a particle size larger than that of the first particles and the second particles have a particle size within a range of more than 50 nm to less than 110 nm.

2. The ink jet recording method according to claim 1, wherein the first particles have a particle size less than 50 nm.

3. The ink jet recording method according to claim 1, wherein the resin is resin particles having a minimum film-forming temperature equal to or lower than the fixing temperature.

4. The ink jet recording method according to claim 3, wherein the first particles have a particle size smaller than that of the resin particles.

5. The ink jet recording method according to claim 3, wherein the second particles have a particle size larger than that of the resin particles.

6. The ink jet recording method according to claim 1, wherein the surface treatment agent contains both the resin and the particles.

7. The ink jet recording method according to claim 1, wherein:

the surface treatment agent-adding step comprises a step of adding a first surface treatment agent and a second surface treatment agent to the image;

the resin is contained in the first surface treatment agent; and the particles are contained in the second surface treatment agent.

8. The ink jet recording method according to claim 1, wherein a contact portion of the fixing member with the image has an elastic modulus of 3 GPa or more.

9. The ink jet recording method according to claim 1, wherein a contact portion of the fixing member with the image has a surface roughness (Ra) of 0.1 μm or less.

10. The ink jet recording method according to claim 1, wherein the image forming step has, in addition to the step of adding the ink to the recording medium, a reaction liquid adding step for adding a reaction liquid containing a component for increasing a viscosity of the ink.

* * * * *